US006214145B1

(12) United States Patent
Umezawa et al.

(10) Patent No.: US 6,214,145 B1
(45) Date of Patent: Apr. 10, 2001

(54) COALESCED MULTIFILAMENT SPANDEX AND METHOD FOR ITS PREPARATION

(75) Inventors: Masao Umezawa; Hideki Nakanishi; Toshikazu Matsuda, all of Shiga (JP)

(73) Assignee: DuPont Toray Co., Ltd., Tokyo (JP)

( * ) Notice: Subject to any disclaimer, the term of this patent is extended or adjusted under 35 U.S.C. 154(b) by 0 days.

(21) Appl. No.: 09/230,194

(22) PCT Filed: Jul. 24, 1997

(86) PCT No.: PCT/US97/12810

§ 371 Date: Jan. 21, 1999

§ 102(e) Date: Jan. 21, 1999

(87) PCT Pub. No.: WO98/28471

PCT Pub. Date: Jul. 2, 1998

(30) Foreign Application Priority Data

Jul. 24, 1996 (JP) ..... 8-214218

(51) Int. Cl.[7] ..... D01D 5/04; D01F 6/70; D02G 3/32

(52) U.S. Cl. ..... 156/167; 156/180; 264/205; 264/210.8; 57/200; 57/362; 57/400

(58) Field of Search ..... 156/167, 180; 264/205, 210.8; 57/362, 400, 200

(56) References Cited

U.S. PATENT DOCUMENTS

| | | | | |
|---|---|---|---|---|
| 3,094,374 | | 6/1963 | Smith . | |
| 3,342,027 | | 9/1967 | Mehler . | |
| 3,353,344 | | 11/1967 | Clendening, Jr. . | |
| 3,558,757 | | 1/1971 | Denyes et al. . | |
| 3,777,470 | | 12/1973 | Suzuki et al. . | |
| 5,061,426 | * | 10/1991 | Frauendorf et al. | 264/205 |
| 5,288,779 | * | 2/1994 | Goodrich | 524/121 |
| 5,362,432 | * | 11/1994 | Houser et al. | 264/205 |
| 5,616,676 | * | 4/1997 | Katsuo | 528/61 |

FOREIGN PATENT DOCUMENTS

| | | |
|---|---|---|
| 0 182 615 | 5/1986 | (EP) . |
| 0 756 026 A1 | 7/1996 | (EP) . |
| 53-139847 | 5/1977 | (JP) . |
| 3-59112 | 7/1989 | (JP) . |
| WO 95/23883 | 9/1995 | (WO) . |

OTHER PUBLICATIONS

Patent Abstracts of Japan, vol. 015, No. 206 (C–0835), May 27, 1991 & JP 03 059112 A (Asahi Chem Ind Co Ltd), Mar. 14, 1991 and translation.

Database WPI, Section Ch, Week 7903, Derwent Publications Ltd., London, GB; Class A25, AN 79–04992B, XP002060040 & JP 53 139 847 A (Unitika Ltd), Dec. 6, 1978.

* cited by examiner

*Primary Examiner*—Sam Chuan Yao
(74) *Attorney, Agent, or Firm*—George A. Frank

(57) ABSTRACT

The present invention provides a process whereby high quality, well-coalesced spandex can be made by dry-spinning a high-melting thermoplastic polyurethane, bundling the as-spun filaments into a side-by-side relationship, and passing the bundled filaments over or through a guide. The spandex made by this method has high heat-settability, high denier uniformity, good knittability and weavability, and provides fabrics having good surface uniformity.

2 Claims, No Drawings

COALESCED MULTIFILAMENT SPANDEX AND METHOD FOR ITS PREPARATION

BACKGROUND OF THE INVENTION

1. Field of the Invention

The present invention relates to a method of preparing a coalesced spandex. More particularly, it relates to a method for dry-spinning a solution of a high-melting thermoplastic polyurethane, bundling the resulting spandex, and fusing the resulting bundle to form the coalesced multifilament spandex by a method which does not employ false-twisting.

2. Description of the Background Art

In the conventional production of a coalesced spandex by dry spinning, a solution of polyurethane or polyurethaneurea is prepared and extruded through spinneret holes into a spinning column. Heat is applied to the inside of the column to drive off the solvent and form filaments. Such filaments are customarily quite small in diameter in order to permit rapid evaporation of solvent. In order to make filaments with larger diameters and to improve the uniformity of the final product, a plurality of filaments are normally bundled together and cohered to each other ("coalesced") along their lengths by passing them through a jet such as described in U.S. Pat. No. 3,353,344. Such a false twist coalescence method is described in, for example, U.S. Pat. No. 3,094,374. Due to the random distribution of any nonuniformities along the length of individual filaments, such irregularities are effectively cancelled out when a number of filaments are thus coalesced, and the resulting coalesced multifilament spandex has improved uniformity over the individual filaments.

European published Patent Application Number 756026 discloses a method wherein immediately after dry-spinning of segmented polyurethaneureas which are not thermoplastic, the filaments are slightly bonded by passing them through a "thread control element with comb-like shape" immediately after spinning to form a multifilament which can be readily and easily split into single filaments.

Japanese published Patent Application Number 53-139847 describes melt-spinning of a low-melting polyurethane from widely spaced spinneret holes and the bonding of the resulting filaments into a coalesced multifilament spandex by passing them through a guide placed at a selected distance from the face of the spinneret.

Spandex is widely used in various applications such as apparel because it has desirable characteristics including high stretch and recovery. Expanding applications have led to new needs such as high uniformity combined with mechanical properties that are available from, for example, thermoplastic polyurethanes and polyurethaneureas. Spandex with desirable properties such as good heat settability, high elastic recovery, and good resistance to environmental conditions can be be prepared by dry-spinning a high-melting thermoplastic polyurethane to make a spandex such as that disclosed in International Patent Application Number WO95123883. Good heat settability is an advantage, for example, when the spandex is to be used in combination with other fibers such as wool which should not be exposed to the temperatures necessary to heat-set such spandex.

However, spandex uniformity tends to be unsatisfactorily low when filaments of such a polyurethane are dry-spun and coalesced by the conventional false-twist coalescence method, perhaps due to fluctuations in the twisting force. As a result, the combination of good uniformity with the desirable properties of a dry-spun thermoplastic polyurethane is still needed.

SUMMARY OF THE INVENTION

In the method of the present invention a solution of high-melting thermoplastic polyurethane is extruded from a spinneret into a heated atmosphere to produce a plurality of filaments which are then brought into a side-by-side relationship with each other and fused into a coalesced multifilament by passing the filaments over or through a guide by a method which does not employ false-twisting.

DETAILED DESCRIPTION OF PREFERRED EMBODIMENTS

As used herein "spandex" has its usual meaning, that is, a manufactured fiber in which the fiber-forming substance is a long chain synthetic elastomer comprised of at least 85% by weight of a segmented polyurethane. "Thermoplastic polyurethane" and "thermoplastic polyurethaneurea" mean a polyurethane and a polyurethaneurea, respectively, with a melting point ("$T_m$") in the range of 150–270° C., preferably in the range of 160° C. to 250° C. and most preferably in the range of 230° C. to 250° C. when measured by differential scanning calorimetry (hereinafter "DSC") and a DSC-measured glass transition temperature ("$T_g$") of no more than 0° C., preferably no more than −20° C.

The present invention provides a method for preparing a coalesced multifilament spandex comprising:

dry spinning a thermoplastic polyurethane to form as-spun filaments;

bundling a plurality of the as-spun filaments in a first guide;

passing the bundled filaments through a second guide to form a coalesced multifilament, neither the first guide nor the second guide creating false twist in the filaments; and winding up the coalesced multifilament;

wherein the thermoplastic polyurethane has a melting point in the range of about 230° C. to 250° C. and a glass-transition temperature no higher than about 0° C. Preferably, the first guide is a comb-shaped guide and the second guide is a slit guide.

The method of the present invention can be applied to filaments comprising primarily polyurethanes, polyurethaneureas, or blends of polyurethanes and polyurethaneureas, so long as the polyurethane, polyurethaneurea or mixture thereof has a $T_m$ in the range of about 150–270° C., preferably in the range of about 160–250° C., and most preferably in the range of about 230° C. to 250° C., and has a $T_g$ of no more than about 0° C., preferably no more than about −20° C. Such high melting temperatures generally require even higher (and therefore impractical) processing temperatures for melt-spinning and, therefore, the resulting spandex is best prepared by dry-spinning from solution.

In order to combine good coalescence by the method of the present invention with good heat settability and satisfactory heat resistance in use, polyurethanes with melting points below 150° C. or above 270° C. should be avoided. If the melting point is too low, the heat is resistance is insufficient. If the melting point is too high, the heat settability and fusability by the method of the present invention are insufficient.

Spandex can be prepared by reacting a polymeric glycol with a diisocyanate to form a "capped glycol", dissolving the capped glycol in a suitable solvent, reacting the dissolved capped glycol with a difunctional chain extender to form the polyurethane or polyurethaneurea in solution, and dry-spinning the solution through a heated spinning column.

Suitable solvents include dimethylacetamide (DMAc), dimethyl-formamide, N-methylpyrrolidone, and the like. This "prepolymer method" is preferred when the chain extender is a diamine. Alternatively, when the chain extender is a diol, melt polymerization can also be used. Reaction of all ingredients can also be carried out in solution for diamine- and diol-extended polymers. When the chain extender is a diol, such polymers are polyurethanes, and when the chain extender is a diamine, such polymers are polyurethaneureas. In solution and melt polymerization, especially when the chain extender is a diol, the ingredients can be added sequentially or all at once (the "one shot method"). In order to make the spandex according to the method of the present invention when the polymer is made in the melt, the polymer is dissolved in a suitable solvent by any suitable method prior to dry-spinning. The solution can also be prepared from one type of polyurethane or two or more types of polyurethane.

The polymeric glycol can be a polyether diol or a polyester diol. Suitable polyether diols include those derived from butanediol, 3-methyl-1,5-pentanediol, tetrahydrofuran, 3-methyltetrahydrofuran, and copolymers thereof. Preferred polyether diols include polytetramethyleneether glycol (PTMEG) and PTMEG having copolymerized therein minor amounts of 3-methyltetrahydrofuran. Glycol-terminated polyesters which can be used in conjunction with the present invention include the reaction products of ethylene glycol, butanediol, and 2,2-dimethyl-1,3-propane diol with diacids such as adipic acid, succinic acid, and dodecanedioic acid. Copolymers can also be used.

Any organic diisocyanate can be used, for example bis(p-isocyanatophenyl)methane ("MDI"), tolylene diisocyanate, bis(4-isocyanatocyclohexyl)methane ("HMDI"), hexamethylene diisocyanate, and 3,3,5-trimethyl-5-methylene-cyclohexyl diisocyanate.

Diol chain extenders which can be used include ethylene glycol, 1,3-propanediol, 1,4-butanediol, neopentyl glycol, 1,2-propanediol, 1,4-cyclohexanediol, 1,4-cyclohexanedimethanol, 1,4-bis(p-hydroxyethoxy)-benzene, bis(β-hydroxyethyl)tere-phthalate, and p-xylenediol. Ethylene glycol and 1,3-propanediol are preferred.

Examples of useful diamine chain extenders include ethylenediamine, 2-methyl-1,5-pentanediamine, 1,3-diamino-cyclohexane, 1,2-propanediamine, 1,3-diaminopropane, 1,4-diaminobutane, and 1,6-diaminohexane. Ethylenediamine is preferred.

A small amount of a monofunctional chain terminator such as diethylamine can be added with the chain extender to control molecular weight.

The diisocyanate and chain extender should be chosen together in order to maintain the $T_m$ and $T_g$ in the selected range. A diol chain extender is preferred when an aromatic diisocyanate such as MDI is used. An aliphatic diisocyanate such as HMDI is preferred when the chain extender is a diamine. More preferred combinations are MDI with ethylene glycol and HMDI with ethylenediamine.

Mixtures of diol and diamine chain extenders can be used, and polymer blends of polyurethanes and polyurethanureas are also acceptable, provided the $T_m$ and $T_g$ are in the specified ranges.

Various additives can be added by any suitable method to the polymer solution before spinning, provided the polymer is not adversely affected with regard to its performance under the conditions of the inventive process. Stabilizers to provide resistance to light and oxidation include 2,6-di-t-butyl-4-methylphenol (butylated hydroxytoluene or BHT), is hindered phenols such as Sumilizer GA-80 (made by Sumitomo Kagaku, Osaka, Japan), benzotriazole and derivatives thereof, phosphorus agents such as Sumilizer P-16 (also made by Sumitomo Kagaku), hindered amine light stabilizers, inorganic pigments such as titanium dioxide and carbon black, metal soaps such as magnesium stearate, bactericides such as silver, zinc, and compounds thereof, deodorizers, lubricants such as various types of silicone and mineral oil, mixtures of huntite and hydromagnesite, barium sulfate, cerium oxide, and various antistatic agents including phosphoric acids.

When especially high durability to light and nitrogen oxides is desired, it is effective to use a nitrogen oxide resisting agent such as HM-150 made by Japan Hydrazine (Tokyo, Japan), thermal oxidation stabilizers such as Sumilizer GA-80 made by Sumitomo Kagaku, and photostabilizers such as Sumisorb 300#622, also made by Sumitomo Kagaku.

The times and methods of adding these additives can vary. For example, they can be mixed into the polyurethane solution by a conventional method such as with a static mixer.

The polymer solution produced in this way is extruded from a spinneret into a heated atmosphere. The heated atmosphere is usually composed primarily of an inert gas such as nitrogen. However, the atmosphere can also contain water vapor and/or steam, as well as other gases. A vacuum can also be applied to the heated atmosphere.

The arrangement of holes in the spinneret can vary. Preferably, however, the spinneret holes are arranged in groups comprising two, three, four or more holes, and therefore each group can produce a plurality of individual filaments. The distance between the holes within each such group is preferably smaller than the distance between the nearest members of adjacent groups of holes.

The extruded solution is made into filaments by drying with heat in a spinning column. These filaments can be paralleled (bundled) by passing them through a first, comb-shaped guide which collects the filaments from each group of spinneret holes so that the filaments are later coalesced (fused) only with other filaments from their own group of spinneret holes. The bundled filaments can then be fused into a coalesced multifilament by passing them over a second guide. The comb guide can be located near the bottom of the spinning column, and the second guide, just outside the bottom of the spinning column, where false-twist jets would normally be in conventional dry-spinning of nonthermoplastic polyurethanes. In order to obtain well-coalesced, nonsplittable multifilaments, it is preferred that lubricating agents such as silicone oil not be applied to the as-spun filament before it is thus bundled and coalesced. Contrary to the method ordinarily used in making coalesced multifilaments by dry-spinning, false twisting is not used in the present invention. It was highly unexpected that passing dry-spun filaments over a guide without false-twisting would result in a coalesced multifilament and that this process would give higher quality spandex than using a false-twist coalescence jet.

There are several types of fiber guides that can be used in the method of the present invention to coalesce the as-spun filaments. Examples include slit guides with V-shaped or U-shaped bottoms, rolls with V- or U-shaped grooves cut into them, closed-ring guides, and pigtail guides, which have the form of a short open-ended helix. Such guides can be ceramic (for example alumina-based) and can be used individually or in combination in the method of the present invention. It is not necessary to heat the guides in the present method.

After coalescence, the multifilament is wound up on a bobbin or tubecore to form a wound package.

The spandex of the present invention can be used alone or with various other types of fibers by knitting, weaving, or stitching it. For example, it can be used appropriately in underwear, stockings, pantyhose, circular knits, tricot knits, bathing suits, ski pants, socks, work clothes, fireproof clothing, western style clothes, men's suits and women's clothes when combined with wool, golf pants, wet suits, brassieres, girdles, gloves, socks, and other various types of control garments, in sanitary products such as disposable diapers, waterproof materials, safety clothing and laboratory wear, hairnets, for wrapping fruits and vegetables, foods, horticulture, electrical insulating materials, cloth wipes, copy cleaners, and gaskets.

The present invention is further explained in detail below in the Examples.

EXAMPLES

DSC measurements were made as follows. Polyurethane in DMAc solvent was applied as a coating either to glass or to polyester film backing that was inert to the polyurethane solution. The solvent in the coated film was removed by drying in 15–150° C. dry gas, and a small portion of the film was peeled from the backing and prepared for DSC measurement. Only films with a residual solvent content of no more than 2% were used. The DSC measurement was taken on the second heating of the film sample.

Coefficient of Denier Variance (CDV) was used as a measure of the uniformity of the coalesced multifilament. The multifilament was removed from a package using a rolling take-off and fed across a tensiometer comprising a piezoelectric ceramic pin. The take-up roll's circumference was 50% greater than the feed roll's circumference, and the feed and take-up rolls rotated at the same rpm, so that the multifilament was stretched to 50% elongation across the tensiometer. The tensiometer measured the tension as the multifilament was fed through the rolls. The average tension, variance, standard deviation, and coefficient of variance were calculated, and the coefficient of variance was reported as CDV, since the denier is directly proportional to the measured tension. A low CDV indicates high fiber uniformity, which results in good fabric uniformity, since tension is applied to the elastomeric fiber during knitting or weaving and low variability in tension creates uniform stitches in the fabric.

Percentages are weight percent unless otherwise noted.

Examples 1, 2, 3 and 4 (which are of the invention) illustrate the method of the present invention and the high quality of the coalesced spandex so produced. Comparison Example 1 illustrates the poor results obtained when as-spun thermoplastic polyurethane is coalesced by means of a conventional false-twist jet. Comparison Example 2 shows that polymers having too high a melting point cannot be coalesced by the method of the present invention. Comparison Example 3 illustrates the use of polymers having a very high melting point (outside the range of the present invention) in making coalesced multifilaments using conventional coalescence jets.

Example 1

1590 g of PTMEG (molecular weight 2500) and 318 g of MDI were placed in a nitrogen-sealed stirred container and reacted at 85° C. to obtain a prepolymer with isocyanate ends. The prepolymer was then dissolved in 3050 g of DMAc. 39 g of ethylene glycol was added as chain extender, and the mixture was heated for 6 hours at 90° C. Polyurethane was then obtained in solution by adding 20 g of butanol as a chain terminator.

The number average molecular weight of the polyurethane thus obtained was approximately 80,000 as measured by gel permeation chromatography (GPC). The DSC melting point of a film cast from the polyurethane solution was approximately 240° C., and the Tg was −70° C.

A spinning solution was produced next by adding 0.8% silicone oil, 0.65% HN-150, 0.33% Sumilizer GA-80, and 0.12% Sumisorb 300#622 as additives.

The spinning solution was made into filaments by spinning it into a 380° C. nitrogen gas heated atmosphere using a spinneret with two adjacent holes 0.25 mm in diameter. Next, the two as-spun filaments were cohered in a ceramic slit guide with a U-shaped bottom which was provided in front of a godet roll, then moved past the godet roll, oil applied, and the resulting coalesced multifilament was wound up at 650 m/min.

The multifilament thus obtained was 22 denier. The shape of the multifilament was an eyeglass shape of two joined circles. The CDV, an indicator of the uniformity of the multifilament, was very good at 11. This multifilament had a strength of 35 g and elongation of 430%. In other words, very high strength spandex was obtained.

When underwear was produced from single covered yarn made by winding 12 denier nylon filament around the above multifilament, the heat set was effective, the target fabric width was attained, and the knit surface was also good. Since the target width was attained, the garments were easy to wear and tolerated 18 days of use in a wear test.

Comparison Example 1

Spinning and processing were conducted by varying only the following parts of Example 1. Specifically, the two strands of the as-spun filament from the spinneret were passed through an air twisting jet in front of the godet roller to cohere them. The coalescence jet was substantially like that described in U.S. Pat. No. 3,353,344.

The coalesced multifilament obtained was 22 denier. The shape of the multifilament was the same as in Example 1, having two joined circles. The CDV, which is an indicator of the uniformity of the multifilament, was high at 22. The uniformity of the multifilament was therefore low. This multifilament had a strength of 36 g and elongation of 450%. When this yarn was covered and made into underwear in the same way as in Example 1, the large amount of knitting mutilation made it impossible to obtain a product.

Example 2

The polyurethane solution of Example 1 was made into as-spun filament by spinning it into a 420° C. nitrogen gas heated atmosphere using a spinneret that had three adjacent holes 0.25 mm in diameter. The three as-spun filaments were cohered by passage through a U-shaped slit guide provided in front of a godet roller, moved past the godet roller, oil applied, and the resulting coalesced multifilament was then wound up at 650 m/min.

The multifilament obtained was 45 denier. The shape of the multifilament was a deformed triangle in which three circles were joined. The CDV of this multifilament was good at 12.

Core spun yarn was produced using the above multifilament in combination with wool. Circular knits were then made by using spun yam of this core spun yarn and wool.

When dyed and heat set at 110° C., the target fabric width was attained and the knit had a good surface.

Comparison Example 2

1410 g of PTMEG (molecular weight 1800) and 310 g of MDI were placed in a nitrogen-sealed stirred container and reacted at 85° C. to obtain a prepolymer with isocyanate ends. Next the prepolymer was dissolved in 3250 g of DMAc and polyurethaneurea was obtained by adding 28 g of ethylenediamine as a chain extender and 4 g of diethylamine as a chain terminator.

The DSC melting point was approximately 280° C. when measured using a film made from the solution. The Tg was −70° C. This solution was spun and processed in the same way as in Example 1. However, the spandex was composed of two independent round-cross-sectioned fibers. The coalesced multifilament of the present invention was not obtained. In an attempt to obtain the multifilament of the present invention, the nitrogen gas temperature in the spinning column was raised to add heat to the filaments. Nonetheless, good multifilament of the same cross section as in Example 1 could still not be produced.

Example 3

1235 g of PTMEG (molecular weight 2500) and 260 g of HMDI were placed in a nitrogen sealed stirred container and reacted at 100° C. to obtain a prepolymer with isocyanate ends. Next, the prepolymer was dissolved in 3390 g of DMAc. Polyurethaneurea solution was obtained by adding 30 g of ethylenediamine as chain extender and 4 g of diethylamine as chain terminator.

The melting point was approximately 240° C. when measured by DSC using a film formed from the polymer solution. The Tg was −70° C.

0.8% silicone oil, 0.65% HN-150, 0.33% Sumilizer GA-80, and 0.12% Sumisorb 300#622 were added to the polymer solution to produce the spinning solution.

The spinning solution was made into as-spun filaments by spinning it into a 360° C. nitrogen gas heated atmosphere using a spinneret that had two adjacent holes 0.25 mm in diameter. Next, the two as-spun filaments were passed through a U-shaped slit guide provided in front of a godet roller, moved past the godet roller, oil applied, and the resulting coalesced multifilament was then wound up at 580 m/min.

The multifilament so obtained was 20 denier. The shape of the multifilament was eyeglass shaped in the same way as in Example 1, having two joined circles. The CDV was good at 12. This multifilament had a strength of 26 g and an elongation of 440%. In other words, high elongation spandex was obtained.

When single covered yarn was produced by winding 12 denier nylon filament around the above coalesced multifilament and this yarn was then mixed knit with 12 denier nylon, the target fabric width was achieved, and the knitted surface was also good. Since heat setting was effective and the target fabric width was attained, the garments were easy to wear and tolerated use for 10 days in a wear test.

When this multifilament was treated for 50 hours by weatherometer, the yellowing ratio of the color was half that of the multifilament of Comparison Example 3, discussed below.

Comparison Example 3

Cohered multifilament was obtained when the solution of is Comparison Example 2 was spun and processed in the same way as in Comparison Example 1.

The fineness was 20 denier. The shape of this multifilament was the same as in Example 1.

The CDV was good at 12. This multifilament had a strength of 20 g and elongation of 510%. In other words, very high elongation polyurethane fibers were obtained. When underwear was made in the same way as in Example 1 using this multifilament, knitting mutilation developed in one area although the cause was uncertain, being due either to low heat settability or the fabric being narrower than the target width. The garments were therefore difficult to wear and gave an overly strong sense of compression when worm. The polyurethane fibers also broke in 4 days in an actual wear test.

Example 4

1590 g of PTMEG (molecular weight 2500), 475 g of MDI, and 95 g of 1,3-propanediol were placed in 3050 g of DMAc, nitrogen-sealed, and reacted for approximately 9 hours at 85° C. in a stirred container. Polyurethane solution was subsequently obtained by adding 20 g of butanol.

The number average molecular weight of the polyurethane was approximately 90,000 as measured by GPC. The DSC melting point was approximately 230° C. when measured on a film formed from said polymer solution. The Tg was −70° C.

Spinning solution was produced by adding 0.8% silicone oil, 0.65% HN-150, 0.33% Sumilizer GA-80, and 0.12% Sumisorb 300#622 to the solution.

The spinning solution was spun into filaments by extruding it into a 380° C. nitrogen gas heated atmosphere using a spinneret that had two adjacent holes 0.25 mm in diameter. The two as-spun filaments next were cohered by passage through a U-shaped slit guide provided in front of a godet roller, moved past the godet roller, oil applied, and the coalesced multifilament was then wound up at 670 m/min.

The multifilament so obtained was 21 denier. The multifilament was eyeglass-shaped with two joined circles. The CDV was very good at 11. This multifilament had a strength of 35 g and elongation of 430%. In other words, very high strength spandex was obtained.

When underwear was made from single covered yarn made by wrapping 12 denier nylon filament around the above multifilament, heat setting was effective, the target fabric width was attained, and the knitted surface was also good. Since the target fabric width was attained, the garments were easy to wear and tolerated 15 days of actual use in a wear test.

What is claimed is:

1. A coalesced multifilament spandex prepared by the method of dry spinning a thermoplastic polyurethane having a melting point in the range of about 160° C. to 250° C. and a glass-transition temperature no higher than about 0° C. to form as-spun filaments;

bundling a plurality of the as-spun filaments in a first guide;

passing the bundled filaments through a second guide to form a coalesced multifilament, neither the first guide nor the second guide creating false-twist in the filaments; and winding up the coalesced multifilament.

2. The coalesced multifilament spandex of claim 1 wherein the polyeurethane is a polyurethaneurea.

* * * * *